US005740553A

United States Patent [19]

Knapp

[11] Patent Number: 5,740,553

[45] **Date of Patent: *Apr. 21, 1998**

[54] GARMENT HAVING A CURVED SEW LINE

[75] Inventor: Barbara Knapp, Pasadeba, Calif.

[73] Assignee: Belle Classic Line, LLC, Pasadena, Calif.

[ * ] Notice: The term of this patent shall not extend beyond the expiration date of Pat. No. 5,459,876.

[21] Appl. No.: 656,275

[22] PCT Filed: Dec. 10, 1994

[86] PCT No.: PCT/US94/14413

§ 371 Date: Jun. 7, 1996

§ 102(e) Date: Jun. 7, 1996

[87] PCT Pub. No.: WO95/15700

PCT Pub. Date: Jun. 15, 1995

Related U.S. Application Data

[63] Continuation-in-part of Ser. No. 165,248, Dec. 10, 1993, Pat. No. 5,459,876.

[51] Int. Cl.[6] ..... A41D 1/22

[52] U.S. Cl. ..... 2/74; 112/475.09

[58] Field of Search ..... 2/74, 105, 106, 2/69, 69.5, 73, 67, 71, 72; 112/475.09, 475.01

[56] References Cited

U.S. PATENT DOCUMENTS 2,066,298 12/1936 Messing .
2,479,091 8/1949 Ackley .
2,886,821 5/1959 Tomii .
3,255,459 6/1966 Way .
3,523,304 8/1970 Nobles .
3,694,817 10/1972 Brown .
3,744,052 7/1973 Rector .
5,083,316 1/1992 Kuehner .
5,093,934 3/1992 Dillon, Jr. .
5,459,876 10/1995 Knapp ..... 2/74

FOREIGN PATENT DOCUMENTS 863993 4/1941 France .

OTHER PUBLICATIONS

"*Apparel Manufacturing Handbook: Analysis, Principles and Practice*". By Jacob Solinger. Copyrighted 1988. pp. 295–298.

"*Pattern Making by the Flat–Pattern Method*". By Norma Hollen and Carolyn Kundel., 6th Edition. ©1987.

"*Draping for Fashion Design*". By Hilde Jaffe. p. 146. ©1973.

English Translation of French Charles Devylerre Patent No. 863,993.

*Primary Examiner*—Peter Nerbun
*Attorney, Agent, or Firm*—Darby & Darby

[57] ABSTRACT

A garment that includes a center front fabric and at least one side front fabric being sewn together along a curved sew line. The curved sew line comprises a concave section, a second convex section and a third concave section. The second convex section is disposed between the first and third section, and points away from center front fabric.

15 Claims, 2 Drawing Sheets

GARMENT HAVING A CURVED SEW LINE

This application is a national stage application filed under 35 USC 371 of PCT/US94/14413, filed Dec. 9, 1994 and a continuation-in-part of the previously filed application, Ser. No. 08/165,248, filed Dec. 10, 1993, now U.S. Pat. No. 5,459,876.

FIELD OF THE INVENTION

The present invention relates to garments having sew lines. More specifically, the present invention relates to garments having a curved sew line between a center front fabric and a side front fabric.

BACKGROUND OF THE INVENTION

Women's outer garments, such as dresses, blouses and the like, are designed to properly fit the woman's body including the bust portion. To accomplish this, it has been proposed to use a curved sew line adjacent to the bust line to attach two or more panels of material. Examples of prior types of garments having curved sew lines are disclosed in U.S. Pat. No. 3,523,304 to Nobles and U.S. Pat. No. 3,255,459 to Way.

Nobles discloses a pre-cut garment construction for women's outer garments, such as dresses, blouses, etc. The stitching line S has a curved shape from cut-outs, 1, 2 for the arm holes down to the hemline of the garment. Bust darts 5 and 6 are used to adjust the size of the garment. Way discloses a pattern for an expanded elastomer suit. FIG. 4 shows the completed suit which includes a seam 320, 322 that includes a vest cut 400, 402 that curves inward toward the bust line.

Notwithstanding the foregoing garments, there are still major problems involved. The use of these garments often require the use of a tuck or dart line near the bust and/or include a concave sew line adjacent to the bust line that does not accentuate or flatter the female figure.

It is, therefore, an object of the present invention to provide a garment that includes a curved sew line adjacent to the bust line that accentuates and flatters the female figure.

SUMMARY OF THE INVENTION

In accordance with the preferred embodiment demonstrating further objects, features and advantages of the present invention, a garment includes a curved sew line between a center front fabric and a side front fabric adjacent to the bust line to flatter the female figure. The curved sew line has a first section, a second convex section and a third section. The second convex section is disposed between the first and third sections. The second convex section points away from the center front fabric and skirts the bust line of the female figure.

BRIEF DESCRIPTION OF THE DRAWINGS

These and other objects, advantages and embodiments will become apparent to those skilled in the art upon reading the following detailed description in conjunction with a review of the appended drawings, in which.

DETAILED DESCRIPTION OF THE PREFERRED EMBODIMENTS

Figure 1:
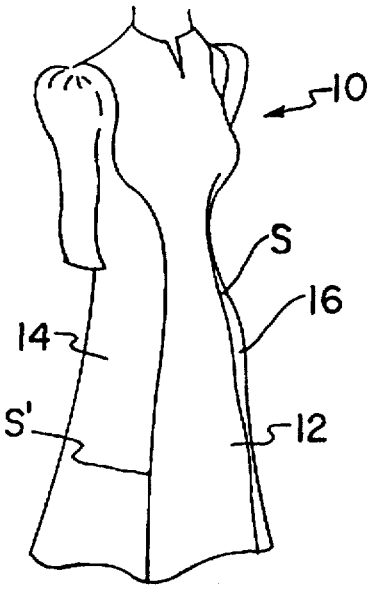
FIG. 1 is a perspective view of a garment having a curved sew line according the present invention.

Referring to FIG. 1, a garment 10, according to the present invention, is illustrated. The garment 10 includes a center front fabric 12 and a pair of side front fabrics 14, 16 that are sewn together by any conventional method such as, for example, a flat-felt seam, an overedged-stitch seam, a french seam, etc.

Figure 2:
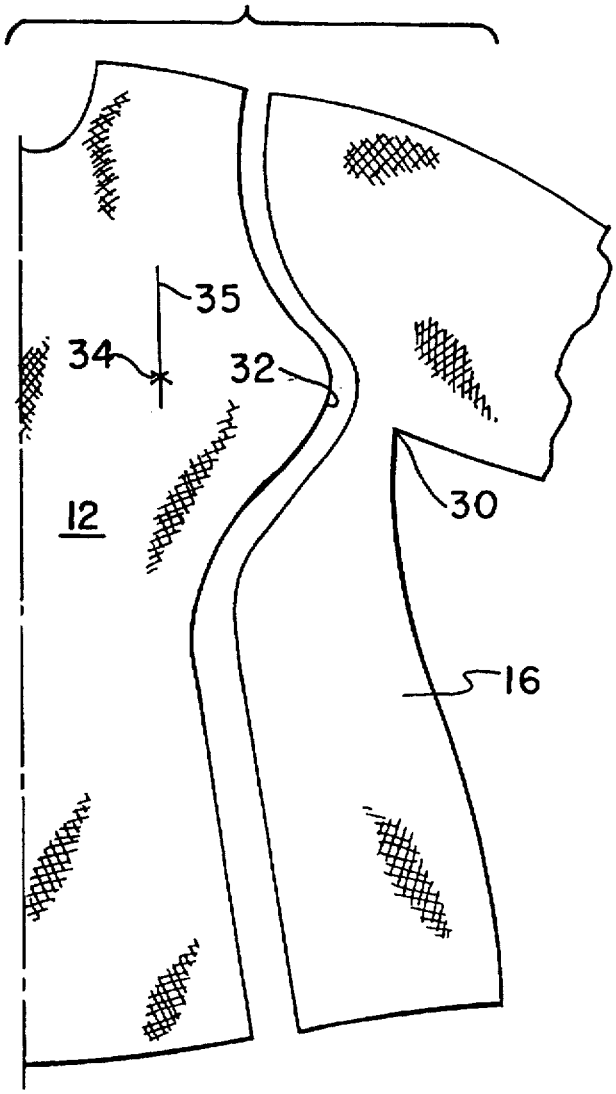
FIG. 2 is a partial plan view of a pre-cut front center panel and side front panel prior to being sewn together.
Figure 3:
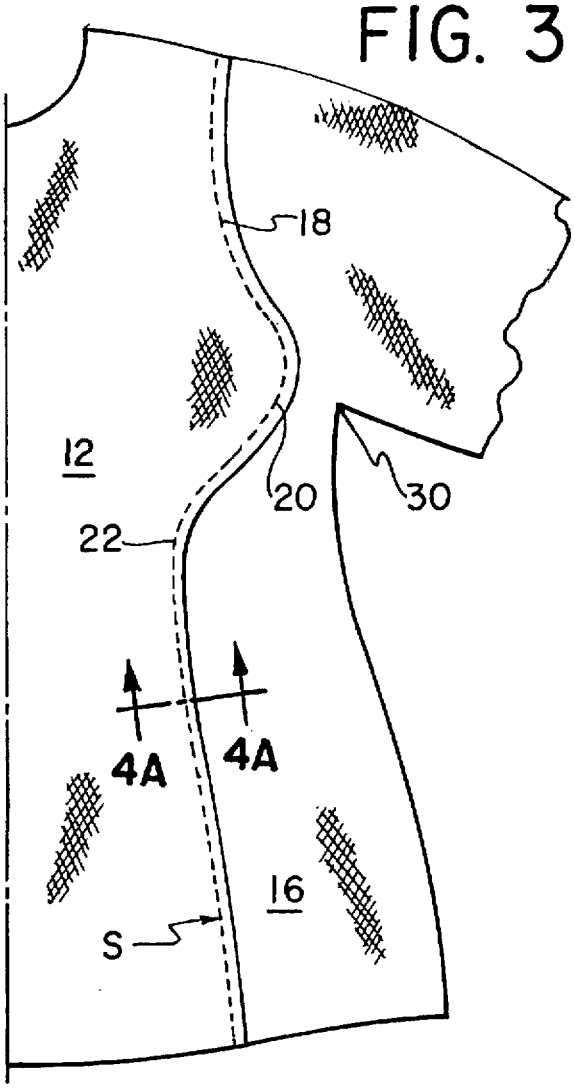
FIG. 3 is a partial plan view of the center front panel and the side front panel being sewn together.

Referring now to FIG. 2, the center front fabric 12 and side front fabric 16 are shown as preferably being pre-cut sections prior to being sewn together. Center front fabric panel 12 is sewn to side front fabric panel 16 along sew line S (see FIG. 3). Sew line S is preferably curved preferably and includes at least three sections, a first concave section 18, a second convex section 20, and a third concave section 22. The first concave section 18 points towards the center front fabric. A method of constructing a curved sew line, per se, is disclosed in the second edition of "Apparel Manufacturing Handbook: Analysis, Principles and Practice" by Jacob Solinger, copyrighted 1988, pages 295–298, the disclosure of which is hereby incorporated by reference. The second convex section 20 is disposed between the first concave section and the third concave section and points away from the center front fabric. The second convex section 20 is designed to skirt the bust line, preferably at the base of the bust, to flatter and accentuate the female figure. Accordingly, the center front fabric 12 has a pair of bust lines defined thereon. The bust lines are imaginary vertical lines that extend through a central point which corresponds to the apex of the breast. Thus, a bust line is defined as a line which extends vertically over and bisects one of the wearer's breasts. The side front fabrics 14, 16 each have an underarm portion 30 which extends beneath a wearers arm. The second convex section 20 has an apex point 32 that is preferably disposed between 25% and 100% of the distance between a central point 34 on the bust line 36 and the underarm portion, where 0% of the distance corresponds to central point 34 and 100% of the distance corresponds to the underarm portion 30. The first section 18 is shown having a concave shape and pointing toward the center front fabric 12. However, in an alternate embodiment (not shown) first section 18 could be a substantially straight sew line S. Similarly, third section 22 is illustrated as having a concave shape pointing toward the center front fabric 12, however, third section 22 could also be substantially straight.

Center front fabric 12 is preferably sewn to side front fabric 14 in a similar manner. Sew line S' between panels 12 and 14 is symmetrical with respect to sew line S between panels 12 and 16.

Figure 4B:
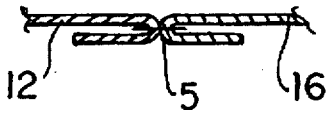
FIGS. 4B and 4C are sectional views showing alternate methods of sewing the center front panel and the side front panel together.
Figure 4C:
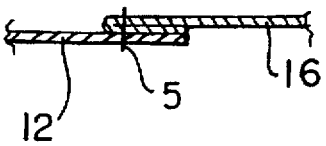
Figure 4A:
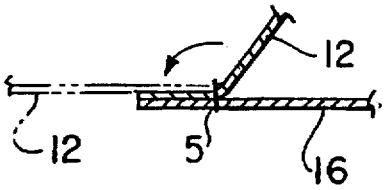
FIG. 4A is a sectional view taken along line 4A—4A of FIG. 3 and looking in the direction of the arrows.

Referring now to FIGS. 4A–4C, various sectional views of sew line S are shown. The sew line S is preferred to be hidden from view. Therefore, the central panel 12 is folded over the sew line S and held in place by pressing, ironing or the like. The actual sectional view in FIG. 4A is shown in phantom. The sectional views illustrated in FIGS. 4B and 4C show alternative examples of how two garment panels can be sewed together.

Figure 5:
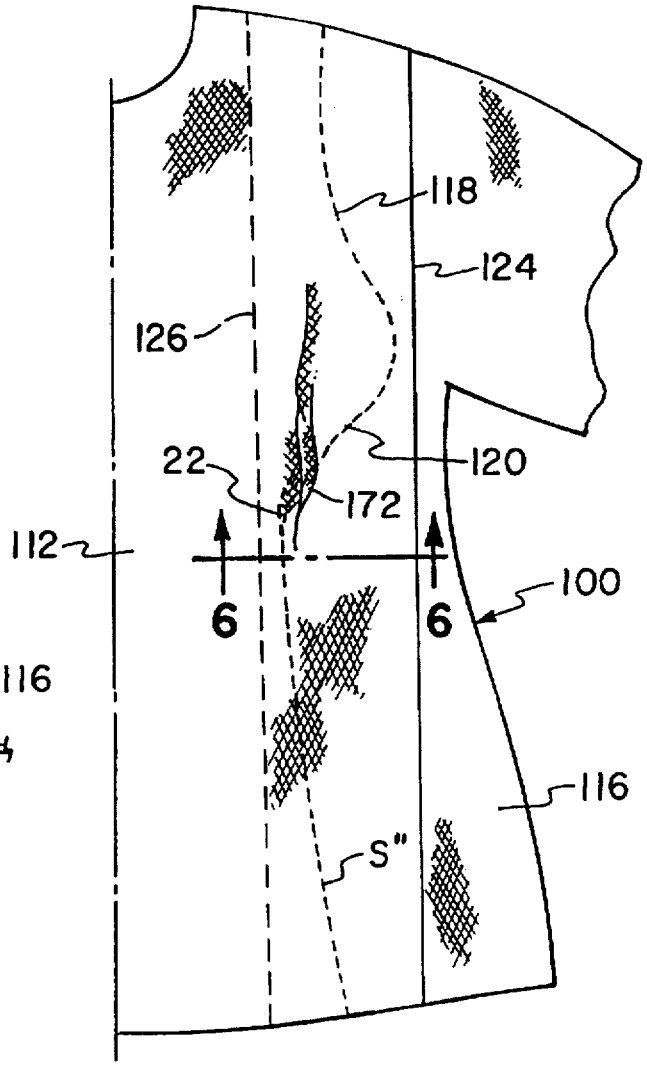
FIG. 5 is a partial plan view showing the center front fabric and the side front fabric sewn together in an overlapping manner.
Figure 6:
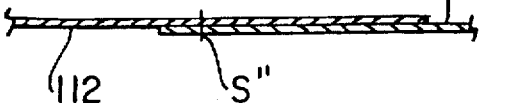
FIG. 6 is a sectional view taken along lines 6—6 of FIG. 5 and looking the direction of the arrows.

Referring now to FIGS. 5 and 6, an alternate method of producing a garment 100 is illustrated. In this embodiment, center front fabric panel 112 and side front fabric panel 116 overlap prior to being sewn together with their respective ends 124, 126 overlapping as illustrated in FIG. 6. Center front fabric 112 and side front fabric 116 are sewn together along seam line S" in substantially the same manner as sew line S discussed above with reference to the embodiment FIGS. 1–4. Accordingly, sew line S" includes the same three curved sections 118, 120, 122 as discussed above with respect to FIGS. 1–4, and for the sake of brevity, the description of the same will not be repeated.

Occasionally, it is desirable to include a tuck adjacent to one of the curved sections of the sew line to permit the garment to lie properly. For example, an optional tuck 172 may be included adjacent to the third curved section 122 as illustrated in FIG. 5. Once the center front fabric 112 and side front fabric panels 114, 116 are sewn together the overlapping portions adjacent the respective ends 124, 126 can be trimmed in a conventional manner.

It will be appreciated that the garment of the present invention successfully attaches a center front fabric panel to a side front fabric panels along a curved sew line in a manner that accentuates or flatters the female figure.

Having described the presently preferred exemplary embodiments of a new and improved garment in accordance with the present invention, it is believed that other modifications, variations and changes will be suggested to those skilled in the art in view of the teaching set forth herein, and it is therefore to be understood that all such variations, modifications and changes fall within the scope of the present invention as defined by the appended claims.

What is claimed is:

1. A garment comprising:

a center front fabric having at least one bust line defined thereon, wherein a bust line extends vertically over and bisects one of the wearer's breasts; and at least one side front fabric being sewn to said center front fabric along a curved sew line, said curved sew line comprising a first section, a second convex section and a third section, said second convex section being disposed between said first and said third sections and pointing away from said center front fabric, said at least one side front fabric having an underarm portion which extends beneath a wearers arm, said second convex section having an apex point that is disposed between 25% and 100% of the distance between a central point on said bust line and said underarm portion, where 0% of the distance corresponds to said central point and 100% of the distance corresponds to said underarm portion.

2. The garment according to claim 1, wherein said second section skirts the bust line.

3. The garment according to claim 1, wherein said first section has a concave shape and points toward said center front fabric.

4. The garment according to claim 2, wherein said third section has a concave shape and points toward said center front fabric.

5. A garment comprising:

a center front fabric having a least one bust line defined thereon, wherein a bust line extends vertically over and bisects one of the wearer's breasts; and a first side front fabric being sewn to said center front fabric along a curved sew line, said curved sew line comprising a first section, a second convex section and a third section, said second convex section being disposed between said first and said third sections and pointing away from said center front fabric, said first side front fabric having an underarm portion which extends beneath a wearers arm, said second convex section having an apex point that is disposed between 25% and 100% of the distance between a central point on said bust line and said underarm portion, wherein 0% of the distance corresponds to said central point and 100% of the distance corresponds to said underarm portion;

a second side front fabric being sewn to said center front fabric along a curved sew line, said curved sew line comprising a first section, a second convex section and a third section, said second convex section being disposed between said first and said third sections and pointing away from said center front fabric, said second side front fabric having an underarm portion which extends beneath a wearers arm, said second convex section having an apex point that is disposed between 25% and 100% of the distance between a central point on said bust line and said underarm portion, where 0% of the distance corresponds to said central point and 100% of the distance corresponds to said underarm portion.

6. The garment according to claim 1, wherein said second section skirts the bust line at the base of the bust.

7. The garment according to claim 1, wherein said first section has a concave shape and points toward said center front fabric.

8. The garment according to claim 7, wherein said third section has a concave shape and points toward said center front fabric.

9. A method of sewing a garment comprising the steps of:

pre-cutting a center front fabric having at least one bust line defined thereon and a side front fabric, wherein a bust line extends vertically over and bisects one of the wearer's breasts; and sewing said center front fabric to said side front fabric along a curved sew line, said curved sew line comprising a first section, a second convex section and a third section, said second convex section being disposed between said first and said third sections and pointing away from said center front fabric, said side front fabric having an underarm portion which extends beneath a wearers arm, said second convex having an apex point that is disposed between 25% and 100% of the distance between a central point on said bust line and said underarm portion, where 0% of the distance corresponds to said central point and 100% of the distance corresponds to said underarm portion.

10. A method according to claim 9, wherein said second section skirts the bust line at the base of the bust.

11. A method according to claim 10, wherein said first section has a concave shape and points toward said center front fabric.

12. A method according to claim 11, wherein said third section has a concave shape and points toward said center front fabric.

13. A method of sewing a garment comprising the steps of:

sewing a center front fabric, having at least one bust line defined thereon to a first side front fabric, wherein a bust line extends vertically over and bisects one of the wearer's breasts;

sewing said center front fabric to a second side front fabric along a curved sew line, said curved lines each comprising a first section, a second convex section and a third section, said second convex section being disposed between said first and said third sections and pointing away from said center front fabric, said first and second side front fabrics each having an underarm portion which extends beneath a wearers arm, said second convex section having an apex point that is disposed between 25% and 100% of the distance between a central point on said bust line and said underarm portion, where 0% of the distance corresponds to said central point and 100% of the distance corresponds to said underarm portion.

14. The garment according to claim 13, wherein said second section skirts the bust line at the base of the bust.

15. The garment according to claim 13, wherein said first section has a concave shape and points toward said center front fabric.

* * * * *

UNITED STATES PATENT AND TRADEMARK OFFICE

CERTIFICATE OF CORRECTION

PATENT NO. : 5,740,553

DATED : April 21, 1998

INVENTOR(S) : Barbara KNAPP

It is certified that error appears in the above-indentified patent and that said Letters Patent is hereby corrected as shown below:

Title page,[22], The PCT filing date "12/10/94" is incorrect. Change to --12/09/94--.

Signed and Sealed this

Sixth Day of April, 1999

*Attest:*

*Attesting Officer*

Q. TODD DICKINSON

*Acting Commissioner of Patents and Trademarks*